US005324367A

United States Patent [19]

Huang

[11] Patent Number: 5,324,367

[45] Date of Patent: Jun. 28, 1994

[54] CAST AND FORGED GAMMA TITANIUM ALUMINUM ALLOYS MODIFIED BY BORON, CHROMIUM, AND TANTALUM

[75] Inventor: Shyh-Chin Huang, Latham, N.Y.

[73] Assignee: General Electric Company, Schenectady, N.Y.

[21] Appl. No.: 44,877

[22] Filed: Apr. 6, 1993

Related U.S. Application Data

[63] Continuation of Ser. No. 801,558, Dec. 2, 1991, abandoned.

[51] Int. Cl.[5] ..... C22C 14/00

[52] U.S. Cl. ..... 148/421; 148/670; 420/418; 420/421

[58] Field of Search ..... 148/421, 670; 420/418, 420/421

[56] References Cited

U.S. PATENT DOCUMENTS

| | | | |
|---|---|---|---|
| 3,203,794 | 8/1965 | Jaffee et al. | 75/175.5 |
| 4,294,615 | 10/1981 | Blackburn et al. | 148/11.5 F |
| 4,639,281 | 1/1987 | Sastry et al. | 148/421 |
| 4,661,316 | 4/1987 | Hashimoto et al. | 420/418 |
| 4,774,052 | 9/1988 | Nagle et al. | 420/590 |
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,857,268 | 8/1989 | Huang et al. | 420/418 |
| 4,879,092 | 11/1989 | Huang | 148/421 |
| 4,897,127 | 1/1990 | Huang | 420/418 |
| 4,902,474 | 2/1990 | Huang et al. | 420/418 |
| 4,916,028 | 4/1990 | Huang | 420/418 |
| 4,923,534 | 5/1990 | Huang et al. | 420/418 |
| 5,028,491 | 7/1991 | Huang et al. | 148/421 |
| 5,032,357 | 7/1991 | Rowe | 420/418 |
| 5,045,406 | 11/1991 | Huang | 148/421 |
| 5,098,653 | 3/1992 | Huang | 420/418 |
| 5,228,931 | 7/1993 | Huang | 148/421 |

FOREIGN PATENT DOCUMENTS

| | | | |
|---|---|---|---|
| 621884 | 6/1961 | Canada . | |
| 0275391 | 7/1988 | European Pat. Off. | C22C 14/00 |
| 0406638 | 1/1991 | European Pat. Off. | C22C 14/00 |
| 0455005 | 11/1991 | European Pat. Off. | C22C 14/00 |
| 298127 | 12/1989 | Japan | C22C 14/00 |

OTHER PUBLICATIONS

"Effect of TiB2 Additions on the Colony Size of Near Gamma Titanium Aluminides", J. D. Bryant, L. Christodoulou, J. R. Maisano, Scripta Metallurgica et Materialia, vol. 24, (1990) pp. 33–38.

"Influence of Matrix Phase Morphology on Fracture Toughness in a Discontinuously Reinforced XD Titanium Aluminide Composite", Scripta Metallurgica et Materialia, vol. 24, (1990) pp. 851–856.

"The Effects of Alloying on the Microstructure and Properties of Ti3Al and TiAl", Titanium 80, (published by the American Society of Metals, Warrendale, Pa.), vol. 2 (1980) pp. 1245–1254.

"Deformation and Failure in Titanium Aluminide" S. M. Barinov, Z. A. Samoilenko, Izvestiya Akademii Nauk SSSR. Metally, No. 3, pp. 164–168, 1984.

"Effect of Rapid Solidification in LloTiAl Compound Alloys", ASM Symposium Proceedings on Enhanced Properties in Struc. Metals Via Rapid Solidification, Materials Week (Oct. 1986), pp. 1–7.

(List continued on next page.)

*Primary Examiner*—Upendra Roy

*Attorney, Agent, or Firm*—Paul E. Rochford; James Magee, Jr.

[57] ABSTRACT

A TiAl composition is prepared to have high strength, high oxidation resistance and to have acceptable ductility by altering the atomic ratio of the titanium and aluminum to have what has been found to be a highly desirable effective aluminum concentration and by addition of chromium and tantalum and boron ingredients according to the approximate formula $Ti\text{-}Al_{46\text{-}50}Cr_2Ta_{2\text{-}4}B_{0.05\text{-}0.2}$. Homogenization of the composition above the alpha transus temperature is used in combination with the boron doping to achieve higher ductility without sacrifice of strength.

10 Claims, 4 Drawing Sheets

OTHER PUBLICATIONS

"Titanium Aluminides-An Overview", H. A. Lispitt, Mat. Res. Soc. Symposium Proc., Materials Research Society, vol. 39 (1985), pp. 351-364.

"Research, Development, and Prospects of TiAl Intermetallic Compound Alloys", T. Tsujimoto, Titanium and Zirconium, vol. 33, No. 3, 159 (Jul. 1985), pp. 1-19.

"Creep Deformation of TiAl and TiAl+W Alloys", P. L. Martin, M. G. Mendiratta, H. A. Lipsitt, Metallurgical Transactions A, vol 14A (Oct. 1983), pp. 2171-2174.

"Plastic Deformation of TiAl and Ti3Al" S. M. L. Sastry, H. A. Lispsitt, Titanium 80 (Published by American Society for Metals, Warrendale, Pa.), vol. 2, (1980), pp. 1231-1243.

"Titanium-Aluminum System", E. S. Bumps, H. D. Kessler, M. Hansen, Transactions AIME, Journal of Metals, Jun. 1952, pp. 609-614.

"Mechanical Properties of High Purity Ti-Al Alloys", H. R. Ogden, D. J. Maykuth, W. L. Finlay, R. I. Jaffee, Transactions AIME, Journal of Metals, Feb. 1953, pp. 267-272.

"Ti-36 Pct Al as a Base for High Temperature Alloys", J. B. McAndrew, JH. D. Kessler, Transactions AIME, Journal of Metals, Oct., 1956., pp. 1348-1353.

"Temperature Dependence of the Strength and Fracture Toughness of Titanium Aluminum", Izv. Akad. Nauk SSSR, Met., vol. 5, 1983, p. 170.

Akademmi Nauk Ukrain SSR, Metallofizikay No. 50, 1974.

"Formulation of Alumina on Ti-Al Alloys", R. A. Perkins, K. T. Chiang, Scripta Metallurgica, vol. 21, 1987, pp. 1505-1510.

CAST AND FORGED GAMMA TITANIUM ALUMINUM ALLOYS MODIFIED BY BORON, CHROMIUM, AND TANTALUM

CROSS REFERENCE TO RELATED APPLICATIONS

This application is a continuation of application Ser. No. 07/801,558, filed Dec. 2, 1991, now abandoned.

The subject application relates to the copending applications as follows:

Ser. No. 07/812,393, filed Dec. 23, 1991, Ser. No. 07/801,556, filed Dec. 2, 1991, Ser. No. 07/801,557, filed Dec. 2, 1991, and Ser. No. 07/811,371, filed Dec. 20, 1991.

Ser. No. 07/354,965, filed May 22, 1989; Ser. Nos. 07/546,962, and 07/546,973, both filed Jul. 2, 1990; Ser. Nos. 07/589,823, and 07/589,827, both filed Sep. 26, 1990; Ser. No. 07/613,494, filed Jun. 12, 1991; Ser. Nos. 07/631,988, and 07/631,989, both filed Dec. 21, 1990; Ser. No. 07/695,043, filed May 2, 1991; and Ser. No. 07/739,004, filed Aug. 1, 1991.

The texts of these related applications are incorporated herein by reference.

BACKGROUND OF THE INVENTION

The present invention relates generally to doped alloys of titanium and aluminum. More particularly, it relates to gamma alloys of titanium and aluminum which have been modified both with respect to stoichiometric ratio and with respect to boron, chromium, and tantalum addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma. The gamma compound, as modified, is the subject matter of the present invention.

The alloy of titanium and aluminum having a gamma crystal form, and a stoichiometric ratio of approximately one, is an intermetallic compound having a high modulus, a low density, a high thermal conductivity, favorable oxidation resistance, and good creep resistance. While the TiAl has good creep resistance it is deemed desirable to improve this creep resistance property without sacrificing the combination of other desirable properties. The relationship between the modulus and temperature for TiAl compounds to other alloys of titanium and in relation to nickel base superalloys is shown in FIG. 3. As is evident from the figure, the TiAl has the best modulus of any of the titanium alloys. Not only is the TiAl modulus higher at higher temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also, the strength of the intermetallic compound at room temperature can use improvement before the TiAl intermetallic compound can be exploited in certain structural component applications. Improvements of the gamma TiAl intermetallic compound to enhance creep resistance as well as to enhance ductility and/or strength at room temperature are also very highly desirable in order to permit use of the compositions at the higher temperatures for which they are suitable.

With potential benefits of use at light weight and at high temperatures, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility for certain applications and higher strengths are often preferred for some applications.

The stoichiometric ratio of gamma TiAl compounds can vary over a range without altering the crystal structure. The aluminum content can vary from about 50 to about 60 atom percent. The properties of gamma TiAl compositions are, however, subject to very significant changes as a result of relatively small changes of one percent or more in the stoichiometric ratio of the titanium and aluminum ingredients. Also, the properties are similarly significantly affected by the addition of relatively similar small amounts of ternary elements.

I have now discovered that further improvements can be made in the gamma TiAl intermetallic compounds by incorporating therein a combination of tantalum and chromium additive elements as well as a low level of boron dopant. Furthermore, I have discovered that the composition including the quaternary additive element has a uniquely desirable combination of properties which include a substantially improved strength, and a desirably high ductility when the composition is cast and forged.

PRIOR ART

There is extensive literature on the compositions of titanium aluminum including the $Ti_3Al$ intermetallic compound, the TiAl intermetallic compounds and the $Ti_3Al$ intermetallic compound. A patent, U.S. Pat. No. 4,294,615, entitled "Titanium Alloys of the TiAl Type" contains an extensive discussion of the titanium aluminide type alloys including the TiAl intermetallic compound. As is pointed out in the patent in column 1, starting at line 50, in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

"Those well skilled recognize that there is a substantial difference between the two ordered phases. Alloying and transformational behavior of $Ti_3Al$ resemble those of titanium, as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy. In Table 2 of the '615 patent, two TiAl compositions containing tungsten are disclosed. However, there is no disclosure in the '615 patent of any compositions TiAl containing chromium or tantalum. There is, accordingly, no disclosure of any TiAl composition containing a combination of chromium, boron, and tantalum.

A number of technical publications dealing with the titanium aluminum compounds as well as with the characteristics of these compounds are as follows:

1. E. S. Bumps, H. D. Kessler, and M. Hansen, "*Titanium-Aluminum System*", Journal of Metals, June 1952, pp 609–614, TRANSACTIONS AIME, Vol. 194.

2. H. R. Ogden, D. J. Maykuth, W. L. Finlay, and R. I. Jaffee, "*Mechanical Properties of High Purity Ti-Al Alloys*", Journal of Metals, February 1953, pp. 267–272, TRANSACTIONS AIME, Vol. 197.

3. Joseph B. McAndrew, and H. D. Kessler, "*Ti-36 Pct Al as a Base for High Temperature Alloys*", Journal of Metals, October 1956, pp. 1348–1353, TRANSACTIONS AIME, Vol. 206.

4. Patrick L. Martin, Madan G. Mendiratta, and Harry A. Lispitt, "*Creep Deformation of TiAl and TiAl+W Alloys*", Metallurgical Transactions A, Volume 14A (October 1983) pp. 2171–2174.

5. P. L. Martin, H. A. Lispitt, N. T. Nuhfer, and J. C. Williams, "*The Effects of Alloying on the Microstructure and Properties of $Ti_3Al$ and TiAl*", Titanium 80, (Published by American Society for Metals, Warrendale, Pa.), Vol. 2, pp. 1245–1254.

6. R. A. Perkins, K. T. Chiang, and KG. H. Meier, "*Formulation of Alumina on Ti-Al Alloys*", Scripta METALLUR-GICA, Vol. 21 (1987) pages 1505–1510.

A discussion of oxidative influences and the effect of additives, including tantalum, on oxidation is contained starting on page 1350 of the Journal of Metals, October 1956, Transactions AIME.

7. S. M. Barinov, T. T. Nartova, Yu L. Krasulin, and T. V. Mogutova, "*Temperature Dependence of the Strength and Fracture Toughness of Titanium Aluminum*", Izv Akad Nauk SSSR, *Met.*, Vol. 5 (1983) p. 170.

In reference 7, Table I, a composition of titanium-36 aliminum-0.01 boron is reported and this composition is reported to have an improved ductility. This composition corresponds in atomic percent to $Ti_{50}Al_{49.97}B_{0.03}$.

8. S. M. L. Sastry, and H. A. Lispitt, "*Plastic Deformation of TiAl and $Ti_3Al$*", Titanium 80 (Published by American Society for Metals, Warrendale, Pa.), Vol. 2 (1980) page 1231.

9. Tokuzo Tsujimoto, "*Research, Development, and Prospects of TiAl Intermetallic Compound Alloys*", Titanium and Zirconlure, Vol. 33, No. 3, 159 (July 1985) pp. 1–13.

10. H. A. Lispitt, "*Titanium Aluminides—An Overview*", Mat. Res. Soc. Symposium Proc., Materials Research Society, Vol. 39 (1985) pp. 351–364.

11. S. H. Whang et al., "*Effect of Rapid Solidification in $Ll_0$TiAl Compound Alloys*", ASM Symposium Proceedings on Enhanced Properties in Struc. Metals Via Rapid Solidification, Materials Week (October 1986) pp. 1–7.

12. Izvestiya Akademii Nauk SSR, Metally. No. 3 (1984) pp. 164–168.

13. D. E. Larsen, M. L. Adams, S. L. Kampe, L. Christodoulou, and J. D. Bryant, "*Influence of Matrix Phase Morphology on Fracture Toughness in a Discontinuously Reinforced XD TM Titanium Aluminide Composite*", Scripta Metallurgica et Materialia, Vol. 24, (1990) pp. 851–856.

14. Akademii Nauk Ukrain SSR, Metallofiyikay No. 50 (1974).

15. J. D. Bryant, L. Christodon, and J. R. Maisano, "*Effect of $TiB_2$ Additions on the Colony Size of Near Gamma Titanium Aluminides*", Scripta Metallurgica et Materialia, Vol. 24 (1990) pp. 33–38.

U.S. Pat. No. 4,661,316 to Hashianoto teaches doping of TiAl with 0.1 to 5.0 weight percent of manganese, as well as doping TiAl with combinations of other elements with manganese. The Hashianoto patent does not teach the doping of TiAl with chromium or with combinations of elements including chromium and particularly not a combination of chromium with tantalum.

Canadian Patent 62,884 to Jaffee discloses a composition containing chromium in TiAl in Table 1 of the patent. Jaffee also discloses a separate composition in Table 1 containing tantalum in TiAl as well as about 26 other TiAl compositions containing additives in TiAl. There is no disclosure in the Jaffee Canadian patent of any TiAl compositions containing combinations of elements with chromium or of combinations of elements with tantalum. There is particularly no disclosure or hint or suggestion of a TiAl composition containing a combination of chromium, boron, and tantalum.

A number of commonly owned patents relating to titanium aluminides and to methods and compositions for improving the properties of such aluminides. These patents include U.S. Pat. Nos. 4,836,983; 4,842,819; 4,857,268; 4,879,092; 4,897,127; 4,902,474, 4,916,028; 4,923,534; 5,032,357; 5,045,406; and 4,842,817 to S. C. Huang and M. F. X. Gigliotti. And, commonly owned U.S. Pat. No. 5,028,491 teaches improvements in titanium aluminides through additions of chromium and niobium. The texts of these commonly owned patents are incorporated herein by reference.

A number of other patents also deal with TiAl compositions as follows:

U.S. Pat. No. 3,203,794 to Jaffee discloses various TiAl compositions.

U.S. Pat. No. 4,842,820, assigned to the same assignee as the subject application, teaches the incorporation of boron to form a tertiary TiAl composition and to improve ductility and strength.

U.S. Pat. No. 4,639,281 to Sastry teaches inclusion of fibrous dispersoids of boron, carbon, nitrogen, and mixtures thereof or mixtures thereof with silicon in a titanium base alloy including Ti-Al.

European patent application 0275391 to Nishiyama teaches TiAl compositions containing up to 0.3 weight percent boron and 0.3 weight percent boron when nickel and silicon are present. No niobium is taught to be present in a combination with boron.

U.S. Pat. No. 4,774,052 to Nagle concerns a method of incorporating a ceramic, including boride, in a matrix by means of an exothermic reaction to impart a second phase material to a matrix material including titanium aluminides.

Japanese Hokai Patent No. Hei 1 (1989) 298127 discloses the independent use of niobium with boron and the separate independent use of chromium with boron as additives among other additives to titanium aluminide.

BRIEF DESCRIPTION OF THE INVENTION

In one of its broader aspects, the objects of the present invention are achieved by providing a nonstoichiometric TiAl base alloy, and adding a relatively low concentration of chromium and a low concentration of boron and tantalum to the nonstoichiometric composition. The addition is followed by casting and forging the doped nonstoichiometric TiAl intermetallic compound. Addition of chromium in the order of approximately 1 to 3 atomic percent and of tantalum to the extent of 1 to 6 atomic percent as well as boron to the extent of about 0.05 to 0.2 atom percent is contemplated.

The alloy of this invention is produced in ingot form and may be processed by conventional low cost cast and forge ingot metallurgy.

BRIEF DESCRIPTION OF THE DRAWINGS

The detailed description of the invention which follows will be understood with greater clarity if reference is made to the accompanying drawings in which.

DETAILED DESCRIPTION OF THE INVENTION

Figure 1:
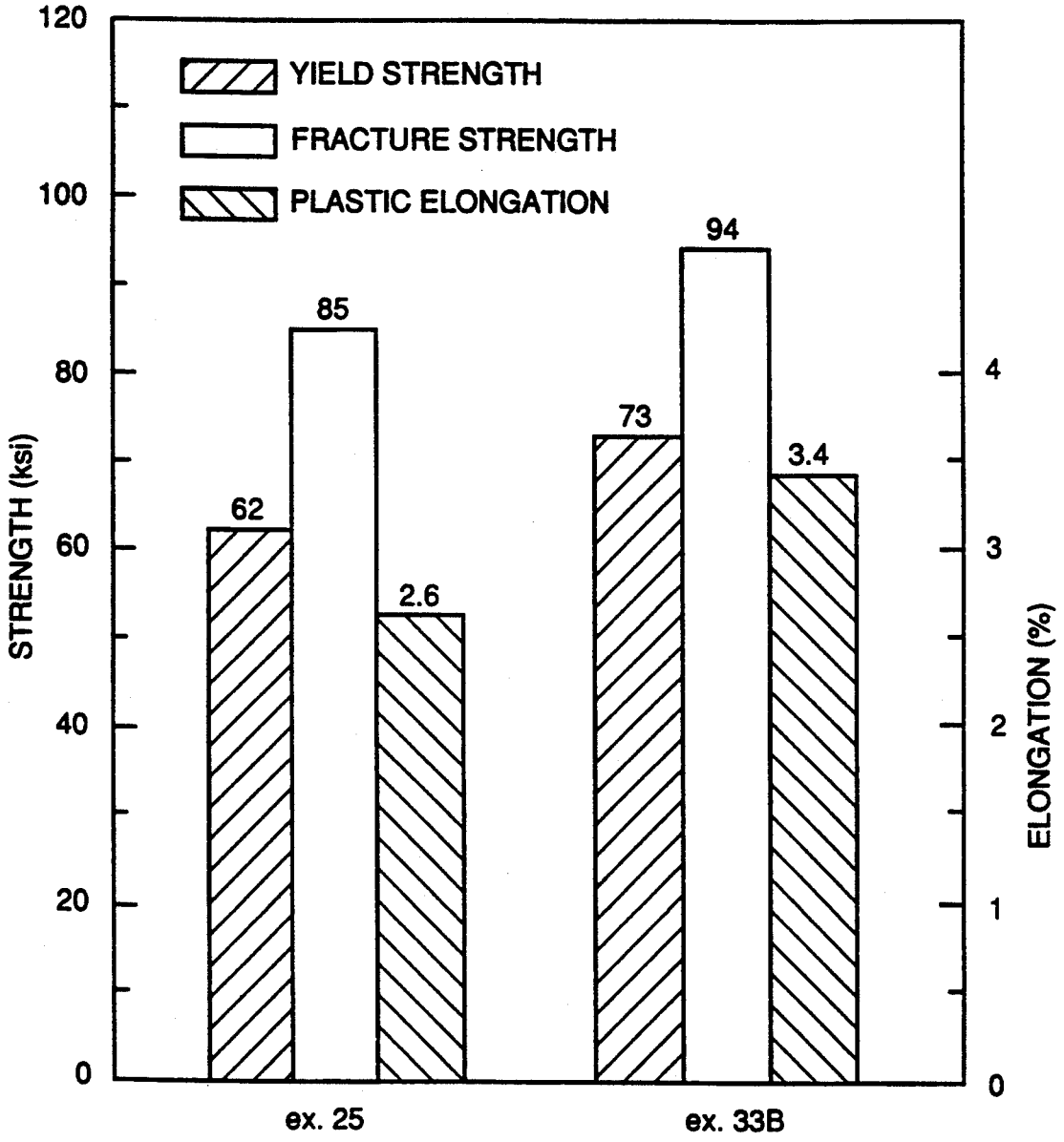
FIG. 1 is a bar graph displaying comparative data for the alloys of this invention relative to a base alloy.

There are a series of background and current studies which led to the findings on which the present invention, involving the combined addition of tantalum, boron, and chromium to a gamma TiAl are based. The first 31 examples deal with the background studies and the later examples deal with the current studies.

EXAMPLES 1-3

Three individual melts were prepared to contain titanium and aluminum in various stoichiometric ratios approximating that of TiAl. The compositions, annealing temperatures and test results of tests made on the compositions are set forth in Table I.

For each example, the alloy was first made into an ingot by electro-arc melting. The ingot was processed into ribbon by melt spinning in a partial pressure of argon. In both stages of the melting, a water-cooled copper hearth was used as the container for the melt in order to avoid undesirable melt-container reactions. Also, care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and was extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of $1.5\times3\times25.4$ mm ($0.060\times0.120\times1.0$ in.) for four point bending tests at room temperature. The bending tests were carried out in a 4-point bending fixture having an inner span of 10 mm (0.4 in.) and an outer span of 20 mm (0.8 in.). The load-crosshead displacement curves were recorded. Based on the curves developed, the following properties are defined:

(1) Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurement results in many of the examples herein is between four point bending tests, and for all samples measured by this technique, such comparisons are quite valid in establishing the differences in strength properties resulting from differences in composition or in processing of the compositions.

(2) Fracture strength is the stress to fracture.

(3) Outer fiber strain is the quantity of 9.71hd, where "h" is the specimen thickness in inches, and "d" is the cross head displacement of fracture in inches. Metallurgically, the value calculated represents the amount of plastic deformation experienced at the outer surface of the bending specimen at the time of fracture.

Figure 2:
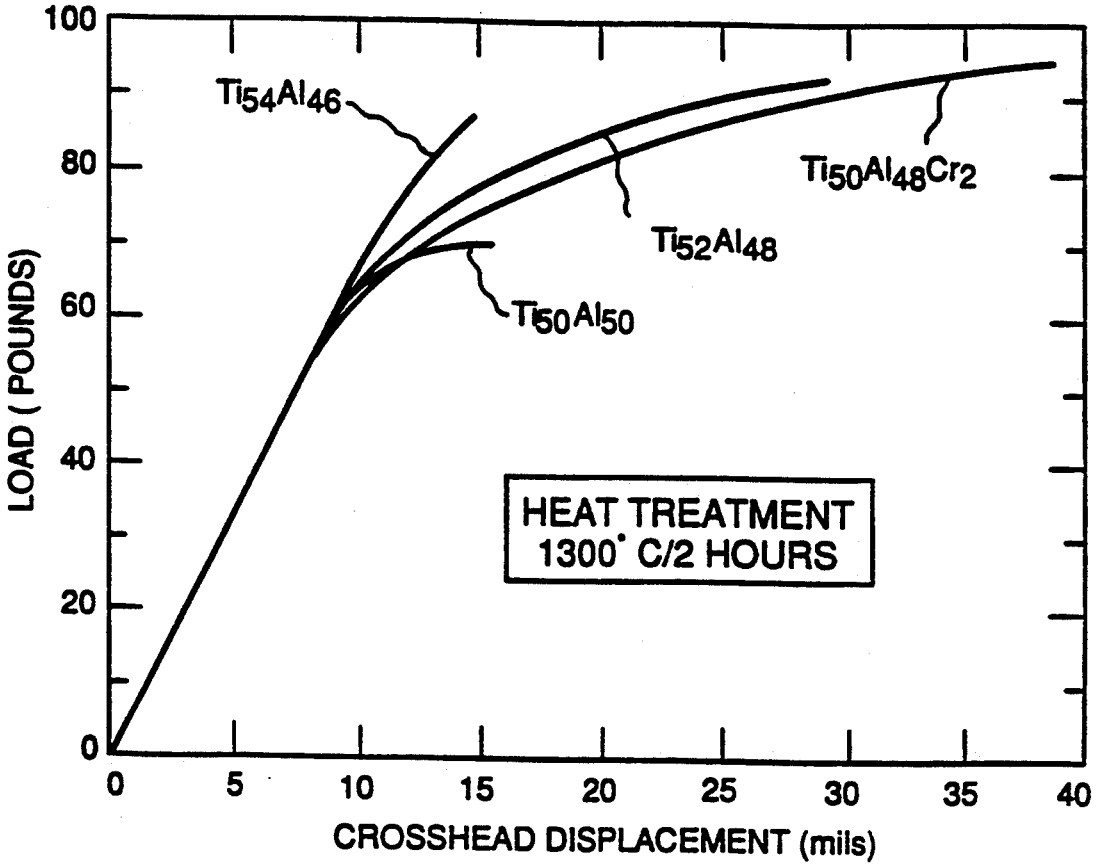
FIG. 2 is a graph illustrating the relationship between load in pounds and crosshead displacement in mils for TiAl compositions of different stoichiometry tested in 4-point bending and for $Ti_{50}Al_{48}Cr_2$.
Figure 3:
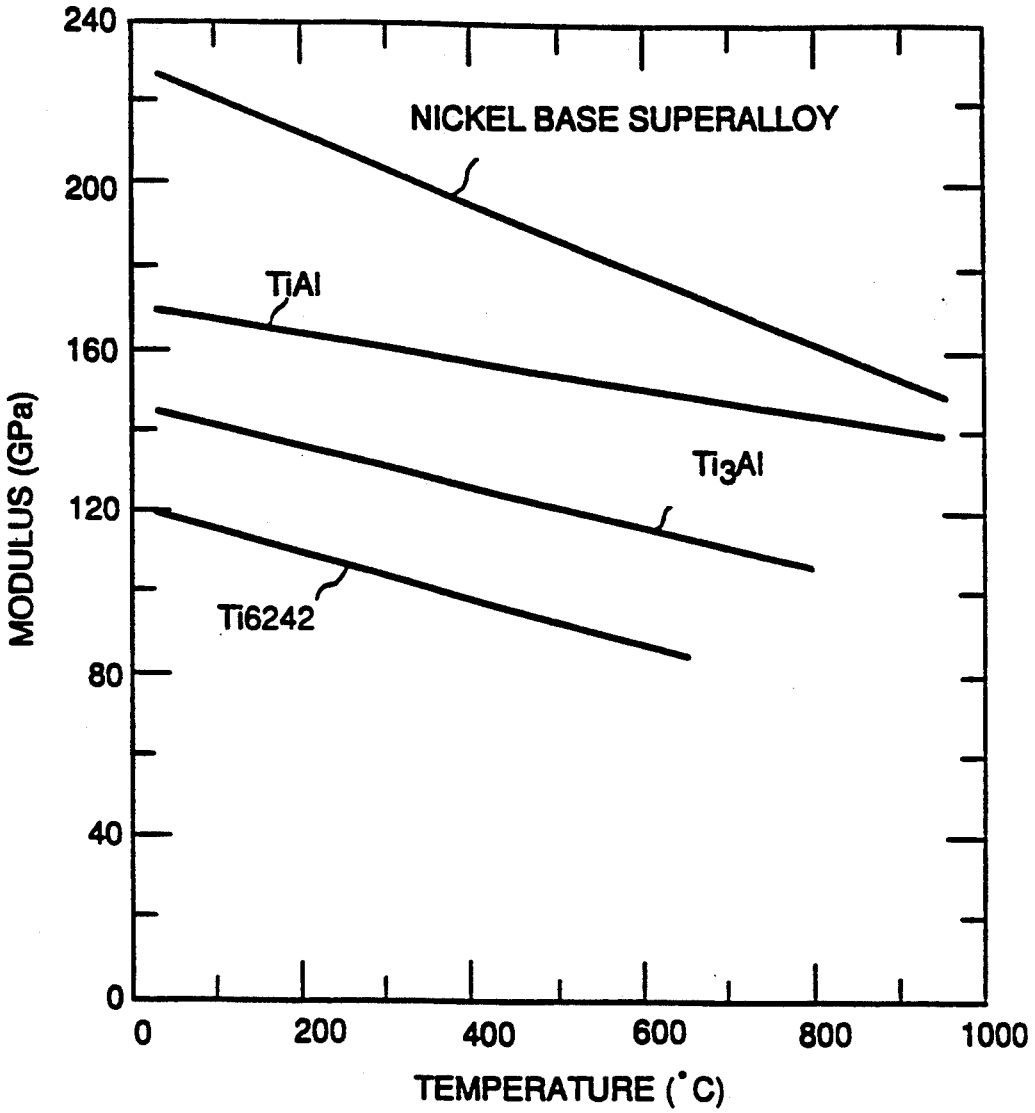
FIG. 3 is a graph illustrating the relationship between modulus and temperature for an assortment of alloys.

The results are listed in the following Table I. Table I contains data on the properties of samples annealed at 1300° C. and further data on these samples in particular is given in FIG. 2.

TABLE I

| Ex. No. | Gamma Alloy No. | Com-posit. (at. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | * | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

*No measurable value was found because the sample lacked sufficient ductility to obtain a measurement It is evident from the data of this Table that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due, in turn, to an extensive beta transformation at temperatures appreciably above 1350° C.

EXAMPLES 4–13

Ten additional individual melts were prepared to contain titanium and aluminum in designated atomic ratios as well as additives in relatively small atomic percents.

Each of the samples was prepared as described above with reference to Examples 1–3.

The compositions, annealing temperatures, and test results of tests made on the compositions are set forth in Table II in comparison to alloy 12 as the base alloy for this comparison.

TABLE II

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 108 | 0.9 |
| | | | 1350 | 88 | 122 | 0.9 |
| 4 | 22 | $Ti_{50}Al_{47}Ni_3$ | 1200 | * | 131 | 0 |
| 5 | 24 | $Ti_{52}Al_{46}Ag_2$ | 1200 | * | 114 | 0 |
| | | | 1300 | 92 | 117 | 0.5 |
| 6 | 25 | $Ti_{50}Al_{48}Cu_2$ | 1250 | * | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.2 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | * | 89 | 0 |
| | | | 1300 | * | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | * | 143 | 0 |
| | | | 1250 | 135 | 154 | 0.3 |
| | | | 1300 | 131 | 149 | 0.2 |
| 13 | 20 | $Ti_{49.5}Al_{49.5}Er_1$ | + | + | + | + |

*See asterisk note to Table I

+ Material fractured during machining to prepare test specimens

For Examples 4 and 5, heat treated at 1200° C., the yield strength was unmeasurable as the ductility was found to be essentially nil. For the specimen of Example 5 which was annealed at 1300° C., the ductility increased, but it was still undesirably low.

For Example 6, the same was true for the test specimen annealed at 1250° C. For the specimens of Example 6 which were annealed at 1300° and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 2, it is evident that the stoichiometric ratio or nonstoichiometric ratio has a strong influence on the test properties which are found for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent, then a composition $Ti_{48}Al_{48}X_4$ will give an effective aluminum concentration of 48 atomic percent and an effective titanium concentration of 52 atomic percent.

If, by contrast, the X additive acts as an aluminum substituent, then the resultant composition will have an effective aluminum concentration of 52 percent and an effective titanium concentration of 48 atomic percent.

Accordingly, the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition, there may be a combined concentration and annealing effect for the additive so that optimum property enhancement, if any enhancement is found, can occur a certain combination of additive concentration and annealing temperature so that higher and lower concentrations and/or annealing temperatures are less effective in providing a desired property improvement.

The content of Table II makes clear that the results obtainable from addition of a ternary element to a non-stoichiometric TiAl composition are highly unpredictable and that most test results are unsuccessful with respect to ductility or strength or to both.

EXAMPLES 14–17

A further parameter of the gamma titanium aluminide alloys which include additives is that combinations of additives do not necessarily result in additive combinations of the individual advantages resulting from the individual and separate inclusion of the same additives.

Four additional TiAl based samples were prepared as described above with reference to Examples 1–3 to contain individual additions of vanadium, tantalum, and niobium as listed in Table III. These vanadium and tantalum containing compositions are the optimum compositions reported in copending commonly owned U.S. Pat. Nos. 4,857,268 and 4,842,817.

The fourth composition is a composition which combines the vanadium, niobium and tantalum into a single alloy designated in Table III to be alloy 48.

From Table III, it is evident that the individual additions vanadium, niobium and tantalum are able on an individual basis in Examples 14, 15, and 16 to each lend substantial improvement to the base TiAl alloy. However, these same additives when combined into a single combination alloy do not result in a combination of the individual improvements in an additive fashion. Quite the reverse is the case.

In the first place, the alloy 48 which was annealed at the 1350° C. temperature used in annealing the individual alloys was found to result in production of such a brittle material that it fractured during machining to prepare test specimens.

Secondly, the results which are obtained for the combined additive alloy annealed at 1250° C. are very inferior to those which are obtained for the separate alloys containing the individual additives.

In particular, with reference to the ductility, it is evident that the vanadium was very successful in substantially improving the ductility in the alloy 14 of Example 14. However, when the vanadium is combined with the other additives in alloy 48 of Example 17, the ductility improvement which might have been achieved is not achieved at all. In fact, the ductility of the base alloy is reduced to a value of 0.1.

Further, with reference to the oxidation resistance, the niobium additive of alloy 40 clearly shows a very substantial improvement in the 4 mg/cm2 weight loss of alloy 40 as compared to the 31 mg/cm2 weight loss of the base alloy. The test of oxidation, and the complementary test of oxidation resistance, involves heating a sample to be tested at a temperature of 982° C. for a period of 48 hours. After the sample has cooled, it is scraped to remove any oxide scale. By weighing the sample both before and after the heating and scraping, a weight difference can be determined. Weight loss is determined in mg/cm2 by dividing the total weight loss in grams by the surface area of the specimen in square centimeters. This oxidation test is the one used for all measurements of oxidation or oxidation resistance as set forth in this application.

For the alloy 60 with the tantalum additive, the weight loss for a sample annealed at 1325° C. was determined to be 2 mg/cm2 and this is again compared to the 31 mg/cm2 weight loss for the base alloy. In other words, on an individual additive basis both niobium and tantalum additives were very effective in improving oxidation resistance of the base alloy.

However, as is evident from Example 17, results listed in Table III alloy 48 which contained all three additives, vanadium, niobium and tantalum in combination, the oxidation is increased to about double that of the base alloy. This is seven times greater than alloy 40 which contained the niobium additive alone and about 15 times greater than alloy 60 which contained the tantalum additive alone.

TABLE III

| Ex. No. | Gamma Alloy No. | Composit. (at. %) | Anneat Temp (°C.) | Yield Strength (ksi) | Fracture Strength (ksi) | Outer Fiber (%) | Weight Loss After 48 hours @ 98° C. (mg/cm$^2$) |
|---|---|---|---|---|---|---|---|
| 2 | 12 | $Ti_{52}Al_{48}$ | 1250 | 130 | 180 | 1.1 | * |
| | | | 1300 | 98 | 128 | 0.9 | * |
| | | | 1350 | 88 | 122 | 0.9 | 31 |
| 14 | 14 | $Ti_{49}Al_{48}V_3$ | 3000 | 94 | 145 | 1.6 | 27 |
| | | | 1350 | 84 | 136 | 1.5 | * |
| 15 | 40 | $Ti_{50}Al_{46}Nb_4$ | 1250 | 136 | 167 | 0.5 | * |
| | | | 1300 | 124 | 176 | 1.0 | 4 |
| | | | 1350 | 86 | 100 | 0.1 | * |
| 16 | 60 | $Ti_{48}Al_{48}Ta_4$ | 1250 | 120 | 147 | 1.1 | * |
| | | | 1300 | 106 | 141 | 1.3 | * |
| | | | 1325 | * | * | * | * |
| | | | 1325 | * | * | * | 2 |
| | | | 1350 | 97 | 137 | 1.5 | * |
| | | | 1400 | 72 | 92 | 0.2 | * |
| 17 | 48 | $Ti_{49}Al_{45}V_2Nb_2Ta_2$ | 1250 | 106 | 107 | 0.1 | 60 |

TABLE III-continued

| Ex. No. | Gamma Alloy No. | Composit. (at. %) | Anneat Temp (°C.) | Yield Strength (ksi) | Fracture Strength (ksi) | Outer Fiber (%) | Weight Loss After 48 hours @ 98° C. (mg/cm²) |
|---|---|---|---|---|---|---|---|
| | | | 1350 | + | + | + | * |

*Not measured
+ Material fractured during machining to prepare test specimen

The individual advantages or disadvantages which result from the use of individual additives repeat reliably as these additives are used individually over and over again. However, when additives are used in combination the effect of an additive in the combination in a base alloy can be quite different from the effect of the additive when used individually and separately in the same base alloy. Thus, it has been discovered that addition of vanadium is beneficial to the ductility of titanium aluminum compositions and this is disclosed and discussed in the commonly owned U.S. Pat. No. 4,827,268. It has been shown by the McAndrew paper discussed above that the individual addition of niobium additive to TiAl base alloy can improve oxidation resistance. Similarly, the individual addition of tantalum is taught by McAndrew as assisting in improving oxidation resistance. Furthermore, in commonly owned U.S. Pat. No. 4,842,817, it is disclosed that addition of tantalum results in improvements in ductility.

In other words, it has been found that vanadium can individually contribute advantageous ductility improvements to gamma titanium aluminum compound and that tantalum can individually contribute to ductility and oxidation improvements. It has been found separately that niobium additives can contribute beneficially to the strength and oxidation resistance properties of titanium aluminum. However, the Applicant has found, as is indicated from this Example 17, that when vanadium, tantalum, and niobium are used together and are combined as additives in an alloy composition, the alloy composition is not benefited by the additions but rather there is a net decrease or loss in properties of the TiAl which contains the niobium, the tantalum, and the vanadium additives. This is evident from Table III.

From this, it is evident that, while it may seem that if two or more additive elements individually improve TiAl that their use together should render further improvements to the TiAl, it is found, nevertheless, that such additions are highly unpredictable and that, in fact, for the combined additions of vanadium, niobium and tantalum a net loss of properties result from the combined use of the combined additives together rather than resulting in some combined beneficial overall gain of properties.

However, from Table III above, it is evident that the alloy containing the combination of the vanadium, niobium and tantalum additions has far worse oxidation resistance than the base TiAl 12 alloy of Example 2. Here, again, the combined inclusion of additives which improve a property on a separate and individual basis have been found to result in a net loss in the very property which is improved when the additives are included on a separate and individual basis.

EXAMPLES 18 thru 23

Six additional samples were prepared as described above with reference to Examples 1-3 to contain chromium modified titanium aluminide having compositions respectively as listed in Table IV.

Table IV summarizes the bend test results on all of the alloys, both standard and modified, under the various heat treatment conditions deemed relevant.

TABLE IV

| Ex. No. | Gamma Alloy No. | Composition (at. %) | Anneal temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 18 | 38 | $Ti_{52}Al_{46}Cr_2$ | 1250 | 113 | 170 | 1.6 |
| | | | 1300 | 91 | 123 | 0.4 |
| | | | 1350 | 71 | 89 | 0.2 |
| 19 | 80 | $Ti_{50}Al_{48}Cr_2$ | 1250 | 97 | 131 | 1.2 |
| | | | 1300 | 89 | 135 | 1.5 |
| | | | 1350 | 93 | 108 | 0.2 |
| 20 | 87 | $Ti_{48}Al_{50}Cr_2$ | 1250 | 108 | 122 | 0.4 |
| | | | 1300 | 106 | 121 | 0.3 |
| | | | 1350 | 100 | 125 | 0.7 |
| 21 | 49 | $Ti_{50}Al_{46}Cr_4$ | 1250 | 104 | 107 | 0.1 |
| | | | 1300 | 90 | 116 | 0.3 |
| 22 | 79 | $Ti_{48}Al_{48}Cr_4$ | 1250 | 122 | 142 | 0.3 |
| | | | 1300 | 111 | 135 | 0.4 |
| | | | 1350 | 61 | 74 | 0.2 |
| 23 | 88 | $Ti_{46}Al_{50}Cr_4$ | 1250 | 128 | 139 | 0.2 |
| | | | 1300 | 122 | 133 | 0.2 |
| | | | 1350 | 113 | 131 | 0.3 |

The results listed in Table IV offer further evidence of the criticality of a combination of factors in determining the effects of alloying additions or doping additions on the properties imparted to a base alloy. For example, the alloy 80 shows a good set of properties for a 2 atomic percent addition of chromium. One might expect further improvement from further chromium addition. However, the addition of 4 atomic percent chromium to alloys having three different TiAl atomic ratios demonstrates that the increase in concentration of an additive found to be beneficial at lower concentrations does not follow the simple reasoning that if some is good, more must be better. And, in fact, for the chromium additive just the opposite is true and demonstrates that where some is good, more is bad.

As is evident from Table IV, each of the alloys 49, 79 and 88, which contain "more" (4 atomic percent) chromium shows inferior strength and also inferior outer fiber strain (ductility) compared with the base alloy.

By contrast, alloy 38 of Example 18 contains 2 atomic percent of additive and shows only slightly reduced strength but greatly improved ductility. Also, it can be observed that the measured outer fiber strain of alloy 38 varied significantly with the heat treatment conditions. A remarkable increase in the outer fiber strain was achieved by annealing at 1250° C. Reduced strain was observed when annealing at higher temperatures. Similar improvements were observed for alloy 80 which also contained only 2 atomic percent of additive although the annealing temperature was 1300° C. for the highest ductility achieved.

For Example 20, alloy 87 employed the level of 2 atomic percent of chromium but the concentration of aluminum is increased to 50 atomic percent. The higher aluminum concentration leads to a small reduction in the ductility from the ductility measured for the two percent chromium compositions with aluminum in the 46 to 48 atomic percent range. For alloy 87, the optimum heat treatment temperature was found to be about 1350° C.

From Examples 18, 19 and 20, which each contained 2 atomic percent additive, it was observed that the optimum annealing temperature increased with increasing aluminum concentration.

From this data it was determined that alloy 38 which has been heat treated at 1250° C., had the best combination of room temperature properties. Note that the optimum annealing temperature for alloy 38 with 46 at. % aluminum was 1250° C. but the optimum for alloy 80 with 48 at. % aluminum was 1300° C. The data obtained for alloy 80 is plotted in FIG. 2 relative to the base alloys.

These remarkable increases in the ductility of alloy 38 on treatment at 1250° C. and of alloy 80 on heat treatment at 1300° C. were unexpected as is explained in the commonly owned U.S. Pat. No. 4,842,819.

What is clear from the data contained in Table IV is that the modification of TiAl compositions to improve the properties of the compositions is a very complex and unpredictable undertaking. For example, it is evident that chromium at 2 atomic percent level does very substantially increase the ductility of the composition where the stoichiometric ratio of TiAl is in an appropriate range and where the temperature of annealing of the composition is in an appropriate range for the chromium additions. It is also clear from the data of Table IV that, although one might expect greater effect in improving properties by increasing the level of additive, just the reverse is the case because the increase in ductility which is achieved at the 2 atomic percent level is reversed and lost when the chromium is increased to the 4 atomic percent level. Further, it is clear that the 4 percent level is not effective in improving the TiAl properties even though a substantial variation is made in the atomic ratio of the titanium to the aluminum and a substantial range of annealing temperatures is employed in studying the testing the change in properties which attend the addition of the higher concentration of the additive.

EXAMPLE 24

Samples of alloys were prepared which had a composition as follows:

$Ti_{52}Al_{46}Cr_2$.

Test samples of the alloy were prepared by two different preparation modes or methods and the properties of each sample were measured by tensile testing. The methods used and results obtained are listed in Table V immediately below.

In Table V, the results are listed for alloy samples 38 which were prepared according to two Examples, 18′ and 24, which employed two different and distinct alloy preparation methods in order to form the alloy of the respective examples. In addition, test methods were employed for the metal specimens prepared from the alloy 38 of Example 18′ and separately for alloy 38 of Example 24 which are different from the test methods used for the specimens of the previous examples.

Turning now first to Example 18′, the alloy of this example was prepared by the method set forth above with reference to Examples 1-3. This is a rapid solidification and consolidation method In addition for Example 18′, the testing was not done according to the 4 point bending test which is used for all of the other data reported in the tables above and particularly for Example 18 of Table IV above. Rather the testing method employed was a more conventional tensile testing according to which a metal samples are prepared as tensile bars and subjected to a pulling tensile test until the metal elongates and eventually breaks. For example, again with reference to Example 18′ of Table V, the alloy 38 was prepared into tensile bars and the tensile bars were subjected to a tensile force until there was a yield or extension of the bar at 93 ksi.

The yield strength in ksi of Example 18′ of Table V, measured by a tensile bar, compares to the yield strength in ksi of Example 18 of Table IV which was measured by the 4 point bending test. In general, in metallurgical practice, the yield strength determined by tensile bar elongation is a more generally used and more generally accepted measure for engineering purposes.

Similarly, the tensile strength in ksi of 108 represents the strength at which the tensile bar of Example 18′ of Table V broke as a result of the pulling. This measure is referenced to the fracture strength in ksi for Example 18 in Table IV. It is evident that the two different tests result in two different measures for all of the data.

With regard next to the plastic elongation, here again there is a correlation between the results which are determined by 4 point bending tests as set forth in Table IV above for Example 18 and the plastic elongation in percent set forth in the last column of Table V for Example 18′.

Referring again now to Table V, the Example 24 is indicated under the heading "Processing Method" to be prepared by ingot metallurgy. As used herein, the term "cast and forge ingot metallurgy" refers to a melting of the ingredients of the alloy 38 in the proportions set forth in Table V and corresponding exactly to the proportions set forth for Example 18′ as well as Examples 18 and 24. In other words, the composition of alloy 38 for both Example 18′ and for Example 24 are identically the same as well as identically the same as Example 18 of Table IV. The difference between the two examples is that the alloy of Example 18′ was prepared by rapid solidification and the alloy of Example 24 was prepared

TABLE V

| Ex. No. | Alloy No. | Composition (at. %) | Processing Method | Anneal Temp (°C.) | Yield Strength (ksi) | Tensile Strength (ksi) | Plastic Elongation (%) |
|---|---|---|---|---|---|---|---|
| 18′ | 38 | $Ti_{52}Al_{46}Cr_2$ | Rapid Solidification | 1250 | 93 | 108 | 1.5 |
| 24 | 38 | $Ti_{52}Al_{46}Cr_2$ | Cast & Forge Ingot Metallurgy | 1225 | 77 | 99 | 3.5 |
| | | | | 1250 | 74 | 99 | 3.8 |
| | | | | 1275 | 74 | 97 | 2.6 |

by cast and forge ingot metallurgy. Again, the cast and forge ingot metallurgy involves a melting of the ingredients and solidification of the ingredients into an ingot followed by forging the ingot. The rapid solidification method involves the formation of a ribbon by the melt spinning method followed by the consolidation of the ribbon into a fully dense coherent metal sample.

The cast and forge processing involves first casting and then forging essentially as follows. In the ingot melting procedure of Example 24 the ingot is cast and prepared to a dimension of about 2" in diameter and about ½" thick in the approximate shape of a hockey puck. Following the melting and solidification of the hockey puck-shaped ingot, the ingot was enclosed within a steel annulus having a wall thickness of about ½" and having a vertical thickness which matched identically that of the hockey puck-shaped ingot. Before being enclosed within the retaining ring the hockey puck ingot was homogenized by being heated to 1250° C. for two hours. The assembly of the hockey puck and containing ring were heated to a temperature of about 975° C. The heated sample and containing ring were forged to a thickness of approximately half that of the original thickness. This is a typical cast and forge processing.

Following the forging and cooling of the specimen, tensile specimens were prepared corresponding to the tensile specimens prepared for Example 18'. These tensile specimens were subjected to the same conventional tensile testing as was employed in Example 18' and the yield strength, tensile strength and plastic elongation measurements resulting from these tests are listed in Table V for Example 24. As is evident from the Table V results, the individual test samples were subjected to different annealing temperatures prior to performing the actual tensile tests.

For Example 18' of Table V, the annealing temperature employed on the tensile test specimen was 1250° C. For the three samples of the alloy 38 of Example 24 of Table V, the samples were individually annealed at the three different temperatures listed in Table V and specifically 1225° C., 1250° C., and 1275° C. Following this annealing treatment for approximately two hours, the samples were subjected to conventional tensile testing and the results again are listed in Table V for the three separately treated tensile test specimens.

Turning now again to the test results which are listed in Table V, it is evident that the yield strengths determined for the rapidly solidified alloy are somewhat higher than those which are determined for the cast and forge ingot processed metal specimens. Also, it is evident that the plastic elongation of the samples prepared through the cast and forge ingot metallurgy route have generally higher ductility than those which are prepared by the rapid solidification route. The results listed for Example 24 demonstrate that although the yield strength measurements are somewhat lower than those of Example 18' they are fully adequate for many applications in aircraft engines and in other industrial uses. However, based on the ductility measurements and the results of the measurements as listed in Table V the gain in ductility makes the alloy 38 as prepared through the cast and forge ingot metallurgy route a very desirable and unique alloy for those applications which require a higher ductility. Generally speaking, it is well-known that processing by cast and forge ingot metallurgy is far less expensive than processing through melt spinning or rapid solidification inasmuch as there is no need for the expensive melt spinning step itself nor for the consolidation step which must follow the melt spinning.

EXAMPLE 25

A sample of an alloy was prepared by cast and forge ingot metallurgy essentially as described with reference to Example 24. The ingredients of the melt were according to the following formula:

$$Ti_{48}Al_{48}Cr_2Ta_2.$$

The ingredients were formed into a melt and the melt was cast into an ingot.

The ingot had dimensions of about 2 inches in diameter and a thickness of about ½ inch.

The ingot was homogenized by heating at 1250° C. for two hours.

The ingot, generally in the form of a hockey puck, was enclosed laterally in an annular steel band having a wall thickness of about one half inch and having a vertical thickness matching identically that of the hockey puck ingot.

The assembly of the hockey puck ingot and annular retaining ring were heated to a temperature of about 975° C. and were then forged at this temperature. The forging resulted in a reduction of the thickness of the hockey puck ingot to half its original thickness.

After the forged ingot was cooled, five pins were machined out of the ingot for three different heat treatments. The five different pins were separately annealed for two hours at the five different temperatures listed in Table VI below. Following the individual anneal, the five pins were aged at 1000° C. for two hours.

After the anneal and aging, each pin was machined into a conventional tensile bar and conventional tensile tests were performed on the resulting bars. The results of the tensile tests are listed in the Table VI.

TABLE VI

Tensile Properties and Oxidation Resistance of Alloys Prepared by Cast and Forge Processing

| | | | Room Temperature Tensile Test of Cast | | | | |
|---|---|---|---|---|---|---|---|
| Ex. No. | Gamma Alloy No. | Composition (at. %) | Anneal Temp(°C.) | Yield Strength (ksi) | Fracture Strength (ksi) | Plastic Elongation (%) | Weight Loss After 48 hours @ 980° C. (mg/cm²) |
| 2A* | 12A | $Ti_{52}Al_{48}$ | 1300 | 54 | 73 | 2.6 | 53 |
| | | | 1325 | 50 | 71 | 2.3 | — |
| | | | 1350 | 53 | 72 | 1.6 | — |
| 25 | 40 | $Ti_{48}Al_{48}Cr_2Ta_2$ | 1250 | 61 | 65 | 0.8 | — |
| | | | 1275 | 62 | 85 | 2.6 | — |
| | | | 1300 | 63 | 82 | 2.7 | 3 |
| | | | 1325 | 63 | 74 | 1.4 | — |

TABLE VI-continued

| Tensile Properties and Oxidation Resistance of Alloys Prepared by Cast and Forge Processing | | | | | | | |
|---|---|---|---|---|---|---|---|
| | | | Room Temperature Tensile Test of Cast | | | | |
| Ex. No. | Gamma Alloy No. | Composition (at. %) | Anneal Temp(°C.) | Yield Strength (ksi) | Fracture Strength (ksi) | Plastic Elongation (%) | Weight Loss After 48 hours @ 980° C. (mg/cm$^2$) |
| | | | 1350 | 62 | 68 | 0.6 | — |

*Example 2A corresponds to Example 2 above in the composition of the alloy used in the example. However, Alloy 12 of Example 2A was prepared by cast and forge ingot metallurgy rather than by the rapid solidification method of Alloy 12 of Example 2. The tensile and elongation properties were tested by the tensile bar method rather than the four point bending testing used for Alloy 12 of Example 2.

As is evident from the Table, the five samples of alloy 140 were individually annealed at the five different temperatures and specifically at 1250°, 1275°, 1300°, 1325° C., and 1350° C. The yield strength of these samples is very significantly improved over the base alloy 12. For example, the sample annealed at 1300° C. had a gain of about 17% in yield strength and a gain of about 12% in fracture strength. This gain in strength was realized with no loss at all in ductility.

However, as the Table VI results also reveal, there was an outstanding improvement in oxidation resistance. This improvement was a reduction in oxidation causing weight loss of about 94 %.

The significantly improved strength, the very desirable ductility, and the vastly improved oxidation resistance when considered together make this a unique gamma titanium aluminide composition.

Figure 4:
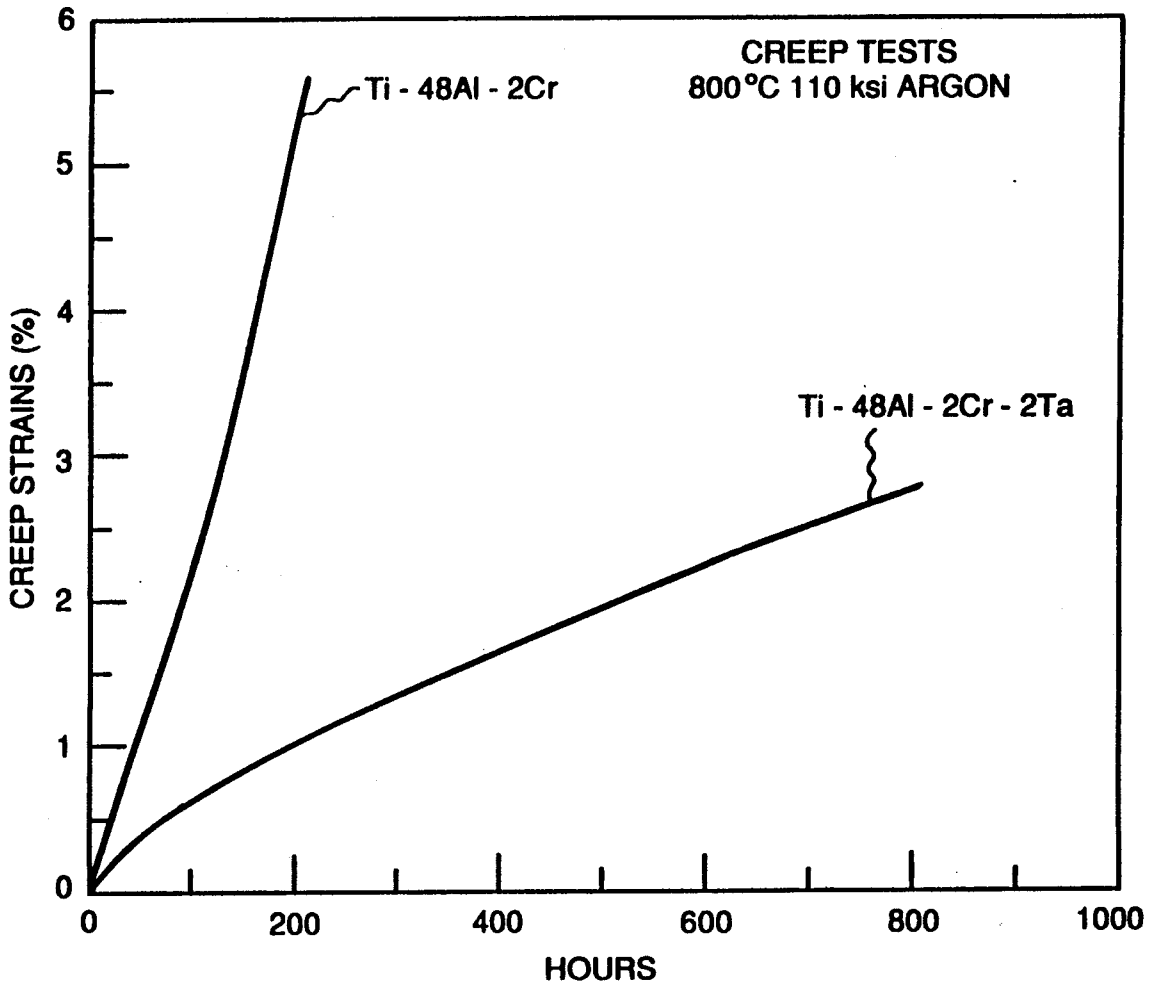
FIG. 4 is a plot of creep strain for two different alloys.

In addition, tests were performed of the creep strain for the alloy 140 of Example 25. A plot of the data showing the creep of $Ti_{48}Al_{48}Cr_2Ta_2$ relative to that of $Ti_{50}Al_{48}Cr_2$ is given in FIG. 4. For the alloy 140 the test was terminated after 800 hours and before the sample fractured. It is evident from the plot of FIG. 4 that the tantalum containing sample is far superior in creep properties to the sample containing chromium but no tantalum.

It is, accordingly, readily evident that the results obtained in this example are in marked contrast to the results obtained in Example 17. In example 17 the inclusion of multiple additives in a gamma TiAl led to cancellation and subtraction of the beneficial influences of the additives when used individually. By contrast, in this example the overall results achieved from inclusion of multiple additives is greater than the results evidenced by separate inclusion of the individual additives. This finding is the subject of commonly owned U.S. Pat. No. 5,028,491, the text of which is included herein by reference.

EXAMPLES 26–30

Five more samples were prepared following the cast and forge procedure as described in Example 24. The compositions of these samples is as set forth in Table VII. Each composition was homogenized at 1300° C. for two hours before being forged.

TABLE VII

| Tensile Properties of Alloys Prepared by Cast and Forge Processing | | | | | | |
|---|---|---|---|---|---|---|
| | | | Room Temperature Tensile Test | | | |
| Ex. No. | Gamma Alloy No. | Composition (at %) | Anneal Temp (°C.) | Yield Strength (ksi) | Fracture Strength (ksi) | Plastic Elongation (%) |
| 26 | 173 | Ti—50Al—2Cr—2Ta | 1300 | 63 | 74 | 1.4 |
| | | | 1325 | 65 | 77 | 1.5 |
| | | | 1350 | 66 | 73 | 0.8 |
| 27 | 171 | Ti—49Al—2Cr—3Ta | 300 | 61 | 73 | 1.6 |
| | | | 1325 | 63 | 80 | 2.3 |
| | | | 1350 | 63 | 79 | 2.1 |
| 28 | 134 | Ti—48Al—2Cr—4Ta | 1250 | 65 | 77 | 1.8 |
| | | | 1275 | 67 | 84 | 2 |
| | | | 1300 | 67 | 87 | 2 |
| | | | 1325 | 68 | 86 | 1.8 |
| | | | 1350 | 67 | 72 | 0.4 |
| 29 | 162 | Ti—50Al—2Cr—4Ta | 1300 | 61 | 67 | 0.5 |
| | | | 1325 | 64 | 76 | 1.3 |
| | | | 1350 | 68 | 79 | 1.5 |
| | | | 1375 | 66 | 79 | 1.4 |
| 30 | 163 | Ti—48Al—2Cr—6Ta | 1250 | 70 | 84 | 1.7 |
| | | | 1275 | 70 | 86 | 2 |
| | | | 1300 | 71 | 88 | 2 |
| | | | 1325 | 67 | 86 | 2.1 |
| | | | 1350 | 71 | 79 | 0.6 |

Table VII also lists the result of tensile testing of these chromium and tantalum containing gamma TiAl compositions. It is evident that in general, the strength values of these alloys is improved over those of Example 2A of Table VI. The ductility values varied over a range but evidenced that significant and beneficial ductility values are achievable with these compositions when prepared by cast and forge processing.

EXAMPLE 31

A melt of 30 to 35 pounds of an alloy having a composition as follows was prepared:

$Ti_{47}Al_{47}Cr_2Ta_4$.

The melt was induction heated and then poured into a graphite mold. The ingot was about 2.75 inches in diameter and about 2.36 inches long.

A sample was cut from the ingot and HIPped at 1175° C. and 15 Ksi for 3 hours. The HIPped sample was then homogenized at 1200° C. for less than 24 hours.

The sample was then isothermally forged at 1175° C. at a strain rate of 0.1 inch/minute and thus reduced to 25% of its original thickness (from 2 inches to 0.5 inches).

The sample was then annealed to 1275° C. for two hours. The tensile properties of the sample were then determined and the results are given in Table VIII.

TABLE VIII

Tensile Properties of $Ti_{47}Al_{47}Cr_2Ta_4$ from Tensile Bar Testing

| Ex. No. | Gamma Alloy No. | Composition (at %) | Anneal Temp (°C.) | Yield Strength (ksi) | Fracture Strength (ksi) | Plastic Elongation (%) |
|---|---|---|---|---|---|---|
| 2A | 12 | $Ti_{52}Al_{48}$ | 1300 | 54 | 73 | 2.6 |
| | | | 1325 | 50 | 71 | 2.3 |
| | | | 1350 | 53 | 72 | 1.6 |
| 31* | 223 | $Ti_{47}Al_{47}Cr_2Ta_4$ | 1275 | 83 | 108 | 2.14 |
| | | | | 84 | 115 | 2.73 |

*The two values of tensile and elongation given are based on duplicate testing of samples of the same alloy.

From the above example, it is evident that the desirable effect of chromium and tantalum additions to TiAl are enhanced by additions of two additional atom percent of tantalum according to the formula $Ti_{47}Al_{47}Cr_2Ta_4$.

Very substantial increases in tensile strength are demonstrated with no loss of ductility and in fact with a gain for the sample registering a 2.73% plastic elongation.

EXAMPLES 32-33

Two additional samples were prepared following the cast and forge procedure as described in Example 24 above. The compositions of these samples is as set forth in Table IX immediately below.

TABLE IX

Tensile Properties of Cast and Forged Boron Doped Titanium Aluminides

| Ex. No. | Alloy No. | Composition (at %) | Room Temperature Tensile Test: Anneal Temp (°C.) | Yield Strength (ksi) | Fracture Strength (ksi) | Plastic Elongation (%) |
|---|---|---|---|---|---|---|
| 32 | 249 | Ti—48Al—2Cr—2Ta—0.2B | 1275 | 70 | 83 | 2.3 |
| | | | 1300 | 66 | 82 | 2.5 |
| 33 | 230 | Ti—47Al—2Cr—3Ta—0.1B | 1275 | 72 | 91 | 2.5 |
| | | | 1300 | 73 | 94 | 2.2 |
| | | | 1325 | 75 | 91 | 1.5 |
| | | | 1350 | 71 | 85 | 1.2 |
| | | | 1375 | 68 | 79 | 1.0 |

NOTE: The alloys of both Examples 32 and 33 were homogenized for two hours at 1300° C. before being forged.

As is evident from the composition of Example 32 as listed in Table IX, the composition is essentially the base alloy 134 of Example 28 to which 0.2 atom percent of boron has been added to the base. Test samples prepared from the cast and forged alloy were individually annealed at 1275° and 1300° C. as indicated in Table IX.

Yield strength, fracture strength, and plastic elongation values were determined for these samples and, as is evident from comparison of Table IX values with the values of alloy 140 of Example 25, some improvement in yield strength is achieved at a relatively small cost in tensile elongation.

For alloy 230 of Table IX, the closest comparison is perhaps with alloy 171 of Example 27 (Table VII), although the aluminum content is alloy 171 is 2 atom percent higher than that of alloy 230. Significant gains in yield strength as well as fracture strength without significant loss of ductility at the lower annealed temperature range is evident from the data in Table IX. It is quite striking that there is a significant decrease in both fracture strength and plastic elongation with increasing anneal temperature for the alloy 230 composition which contained the 0.1 percent boron dopant additive.

In general, the two alloys of Table IX, specifically alloys 249 and 230, have similar properties.

EXAMPLE 28B

One additional sample was prepared following the cast and forge procedure as described in Example 24 above. However, in this case the sample was homogenized at 1400° C. rather than at the 1300° C. temperature used for a comparitive example, and specifically for alloy 134 of Example 28. The composition of the sample as well as the annealing temperature, the yield strength, fracture strength, and plastic data obtained from tensile testing of the alloy of Example 28B is given in Table X immediately below.

TABLE X

Tensile Properties of Cast and Forged Titanium Aluminide

| Ex. No. | Alloy No. | Composition (at %) | Anneal Temp (°C.) | Yield Strength (ksi) | Fracture Strength (ksi) | Plastic Elongation (%) |
|---|---|---|---|---|---|---|
| 28B* | 134 | Ti—48—2Cr—4Ta | 1275 | 70 | 77 | 1.4 |
| | | | 1275 | 68 | 82 | 2.4 |
| | | | 1300 | 69 | 83 | 2.4 |

TABLE X-continued

| Tensile Properties of Cast and Forged Titanium Aluminide | | | | | | |
|---|---|---|---|---|---|---|
| Ex. No. | Alloy No. | Composition (at %) | Anneal Temp (°C.) | Yield Strength (ksi) | Fracture Strength (ksi) | Plastic Elongation (%) |
| | | | 1325 | 68 | 85 | 2.0 |

NOTE: Example 28B corresponds to Example 28 of Table VII in the composition used. However, the alloy of this example was prepared by homogenization of ingot at 1400° C. for two hours before forging, rather than the 1300° C. homogenization received by the alloy of Example 28.

The data presented in Table X above is for alloy 134 containing 2 atom percent chromium and 4 atom percent tantalum. This alloy is the same as that set forth in Example 28 of Table VII above. This example 28B is essentially a duplicate of Example 28 of Table VII with the exception that the alloy was homogenized at 1400° C. for two hours while the alloy 134 of Example 28 was homogenized at 1300° C. for two hours. The comparison of the data of these two examples indicates that the 1400° homogenization results in an increase in ductility with no significant change in the yield strength or in the fracture strength of the sample.

EXAMPLES 34 and 33B

Two more samples were prepared following the cast and forge procedure as described in Example 24. Compositions for each of these samples were homogenized at 1400° C. for two hours before the forging operation as recited in Example 24. The compositions of these samples is set forth in Table XI immediately below.

TABLE XI

| Ex. No. | Alloy No. | Composition (at %) | Anneal Temp (°C.) | Yield Strength (ksi) | Fracture Strength (ksi) | Plastic Elongation (%) |
|---|---|---|---|---|---|---|
| 34 | 227 | Ti—48Al—0.1B | 1275 | 69 | 76 | 1.7 |
| | | | 1300 | 64 | 67 | 0.9 |
| | | | 1325 | 58 | 70 | 1.6 |
| 33B* | 230 | Ti—47Al—2Cr—3Ta—0.1B | 1250 | 73 | 86 | 1.9 |
| | | | 1275 | 73 | 94 | 3.4 |
| | | | 1300 | 72 | 91 | 2.9 |
| | | | 1325 | 75 | 83 | 0.7 |

*Example 33B corresponbds to Example 33 in the alloy composition used. However, this example was pre-pared by homogenization of ingot at 1400° C., ratherthan at 1300° C. as in the previous example.

In Example 34 the alloy is the basic reference binary alloy Ti-48Al to which 0.1 atom percent of boron dopant has been added. Example 34 is thus comparable to Example 2A of Table VIII with two exceptions. The first exception is that the alloy 2A of Table VIII did not contain boron whereas the alloy 227 of Example 34 contains 0.1 atom percent boron. The second exception is that the alloy 227 of Example 34 was homogenized at 1400° C. whereas the alloy 12 of Example 2A of Table VIII was homogenized at 1200° C. for 24 hours.

A comparison of the tensile data of Table XI for alloy 227 with the similar data of alloy 12 of Table VIII reveals that there is a gain in yield strength for alloy 227 but an offsetting loss of plastic elongation or ductility for the same alloy when compared to alloy 12 of Table VIII.

The second example of Table XI is Example 33B. This example is a modification of Example 33 of Table IX. As is noted from comparison of the two tables, and specifically Tables IX and XI, the alloy number is the same and the alloy composition is identically the same and is Ti-47Al-2Cr-3Ta-0.1B. In other words, the essential difference between the Example 33B of Table XI and Example 33 of Table IX is that the alloy 230 of Example 338 was homogenized at 1400° C. for 2 hours in the practice of Example 33B whereas the same alloy was homogenized at 1300° C. in Example 33 of Table IX. The yield strength of the two samples is essentially the same and the fracture strength for the two samples is also essentially the same. What is remarkable, however, is that there is a gain in ductility for alloy 230 of Example 33B to a level of 3.4 for the sample annealed at 1275° C. The gain in ductility from the 100° C. difference in homogenization temperature is about 36%. This is a very significant gain in the ductility of a titanium aluminide inasmuch as most of these materials are brittle at room temperature and have fractional ductilities or no ductility at all. An important aspect of the development of this class of alloys is the generation of an appreciable ductility. The ductility of 3.4 percent is in this regard very significant.

The comparison of the difference of ductility resulting from the 100° increase in the homogenization temperature may be made by the comparison of the results obtained for Example 28B of Table X with the results obtained for Example 28 of Table VII. As noted above, the Example 28B differed from the Example 28 in that the homogenization temperature of the 28B example was at 1400° C. whereas that for Example 28 was at 1300° C. As is evident from the comparison of the data of Tables VIII and IX, and as has been discussed above, there is an appreciable gain in the plastic elongation for Example 28B. This gain amounts to about 20%. The gain, however, for Example 33B as compared to Example 33 is almost double that obtained for the alloy which did not contain the boron additive.

Accordingly, the optimum composition in processing is one in which the boron dopant is incorporated along with the chromium and tantalum additives and the homogenization is carried out at the 1400° C. temperature. The 1400° C. homogenization temperature is effective in improving the ductility of the titanium aluminide containing the chromium and tantalum additives but the improvement is not as great as when the boron dopant is also present. This gain in ductility is achieved in both cases without a sacrifice of either yield strength or fracture strength.

Further, it is clear from the comparison of the results obtained in Examples 34 and 2A that the doping with boron is not effective in improving the ductility of a ternary alloy and specifically Ti-48Al-0.1B. This finding is contrary to and contradicts the teaching of Technical Publication No. 7 identified in the discussion of prior art given above.

From the foregoing, it is evident that the combination of boron doping and higher temperature homogenization is most effective and uniquely effective in achieving a 36% gain in ductility to a value of 3.4 percent for the composition containing the boron doping and the composition which is homogenized at the higher temperature of 1400° C. or about 1375° to 1425° C.

One possible explanation of the uniquely improved results is that a novel combination of additive ingredients and higher homogenization temperature has been employed in preparing the cast and forge compositions of this invention. In particular, the combination of chromium, tantalum, and boron within the defined ranges is coupled with higher temperature processing and specifically higher homogenization temperature. The preferred higher homogenization temperature is a temperature above the alpha transus of the alloy.

What is claimed and sought to be protected by Letters Patent of the United States is:

1. A chromium, boron, and tantalum modified titanium aluminum alloy having an alpha transus temperature and consisting essentially of titanium, aluminum, boron, chromium, and tantalum in the following approximate atomic ratio:

$$Ti\text{-}Al_{46\text{-}50}Cr_{1\text{-}3}Ta_{1\text{-}6}B_{0.05\text{-}0.2},$$

said alloy having been homogenized at a temperature above the alpha transus of the alloy, and having been forged following the homogenization.

2. A chromium, boron, and tantalum modified titanium aluminum alloy consisting essentially of titanium, aluminum, boron, chromium, and tantalum in the approximate atomic ratio of:

$$Ti\text{-}Al_{46\text{-}50}Cr_{1\text{-}3}Ta_{2\text{-}4}B_{0.05\text{-}0.2},$$

said alloy having been homogenized at a temperature above the alpha transus of the alloy, and having been forged following the homogenization.

3. A chromium, boron, and tantalum modified titanium aluminum alloy consisting essentially of titanium, aluminum, boron, chromium, and tantalum in the following approximate atomic ratio:

$$Ti\text{-}Al_{46\text{-}50}Cr_{2}Ta_{1\text{-}6}B_{0.05\text{-}0.2},$$

said alloy having been homogenized at a temperature above the alpha transus of the alloy, and having been forged following the homogenization.

4. A chromium, boron, and tantalum modified titanium aluminum alloy consisting essentially of titanium, aluminum, boron, chromium, and tantalum in the approximate atomic ratio of:

$$Ti\text{-}Al_{46\text{-}50}Cr_{2}Ta_{2\text{-}4}B_{0.05\text{-}0.2},$$

said alloy having been homogenized at a temperature above the alpha transus of the alloy, and having been forged following the homogenization.

5. A chromium, boron, and tantalum modified titanium aluminum alloy consisting essentially of titanium, aluminum, boron, chromium, and tantalum in the approximate atomic ratio of:

$$Ti\text{-}Al_{46\text{-}50}Cr_{1\text{-}3}Ta_{1\text{-}6}B_{0.1},$$

said alloy having been homogenized at a temperature above the alpha transus of the alloy, and having been forged following the homogenization.

6. A chromium, boron, and tantalum modified titanium aluminum alloy consisting essentially of titanium, aluminum, boron, chromium, and tantalum in the following approximate atomic ratio:

$$Ti\text{-}Al_{46\text{-}50}Cr_{2}Ta_{2\text{-}4}B_{0.1},$$

said alloy having been homogenized at a temperature above the alpha transus of the alloy, and having been forged following the homogenization.

7. A structural component for use at high strength and high temperature, said component being formed of a chromium, boron, and tantalum modified titanium aluminum gamma alloy consisting essentially of titanium, aluminum, boron, chromium and tantalum in the following approximate atomic ratio:

$$Ti\text{-}Al_{46\text{-}50}Cr_{1\text{-}3}Ta_{1\text{-}6}B_{0.05\text{-}0.2},$$

said alloy having been homogenized at a temperature above the alpha transus of the alloy, and having been forged following the homogenization.

8. The component of claim 7, wherein the component is a structural component of a jet engine.

9. The component of claim 7, wherein the component is reinforced by filamentary reinforcement.

10. The component of claim 9, wherein the filamentary reinforcement is silicon carbide filaments.

* * * * *